US007782173B2

(12) United States Patent
Urano et al.

(10) Patent No.: US 7,782,173 B2
(45) Date of Patent: Aug. 24, 2010

(54) CHIP RESISTOR

(75) Inventors: Koichi Urano, Ina (JP); Yasushi Akahane, Ina (JP)

(73) Assignee: KOA Corporation, Ina-shi (JP)

( * ) Notice: Subject to any disclaimer, the term of this patent is extended or adjusted under 35 U.S.C. 154(b) by 371 days.

(21) Appl. No.: 12/066,846

(22) PCT Filed: Sep. 21, 2006

(86) PCT No.: PCT/JP2006/318737

§ 371 (c)(1),
(2), (4) Date: Mar. 14, 2008

(87) PCT Pub. No.: WO2007/034874

PCT Pub. Date: Mar. 29, 2007

(65) Prior Publication Data

US 2009/0108986 A1 Apr. 30, 2009

(30) Foreign Application Priority Data

Sep. 21, 2005 (JP) ..... 2005-274231

(51) Int. Cl.
*H01C 1/012* (2006.01)

(52) U.S. Cl. ..... 338/307; 338/309; 427/102

(58) Field of Classification Search ..... 338/307–309; 427/102–103

See application file for complete search history.

(56) References Cited

U.S. PATENT DOCUMENTS 4,829,553 A * 5/1989 Shindo et al. ..... 338/309
5,907,274 A 5/1999 Kimura et al.
6,314,637 B1 11/2001 Kimura et al.
6,356,184 B1 * 3/2002 Doi et al. ..... 338/309
6,982,624 B2 * 1/2006 Saito et al. ..... 338/309
7,098,768 B2 * 8/2006 Doi ..... 338/309

FOREIGN PATENT DOCUMENTS

JP 10-144501 A 5/1998
JP 2000-36401 A 2/2000
JP 2002-353001 A 12/2002

OTHER PUBLICATIONS

International Search Report dated Dec. 26, 2006 with English translation of relevant portion (Three (3) pages).

* cited by examiner

*Primary Examiner*—Kyung Lee
(74) *Attorney, Agent, or Firm*—Crowell & Moring LLP

(57) ABSTRACT

The chip resistor 10 includes a ceramic substrate 11 that is shaped like a rectangular parallelepiped. Mounted on the lower surface of the ceramic substrate 11 are a resistive element 12 that is made mainly of a low-resistance, low-TCR copper-nickel alloy, first and second electrode layers 13, 14 that form a two-layer structure and cover both longitudinal ends of the resistive element 12, and an insulating protective layer 15 for covering the remaining area of the resistive element 12. The resistive element 12 is positioned within a region inside the peripheral border of the lower surface of the ceramic substrate 11. The chip resistor 10 also includes end-face electrodes 17 that are positioned on both longitudinal end faces of the ceramic substrate 11. The second electrode layers 14 and end-face electrodes 17 are covered by plating layers 18-21. This chip resistor 10 is to be face-down mounted with both electrode layers 13, 14 positioned on a wiring pattern 31 of a circuit board 30.

2 Claims, 4 Drawing Sheets

CHIP RESISTOR

TECHNICAL FIELD

The present invention relates to a chip resistor, and more particularly to a low-resistance chip resistor that is used, for instance, for current detection in an electronic circuit.

BACKGROUND ART

Chip resistors are structured so that a resistive element made, for instance, of ruthenium oxide is positioned between a pair of electrode sections. However, a chip resistor used, for instance, for electronic circuit current detection needs to have a resistance value of not higher than 1Ω. A technology that uses a resistive element made mainly of copper to obtain such a low-resistance chip resistor has long been known (refer, for instance, to Patent Document 1).

FIG. 5 is a cross-sectional schematic view illustrating a conventionally known low-resistance chip resistor. The chip resistor 1 shown in FIG. 5 includes a resistive element 3, which is made mainly of a copper-nickel alloy and positioned on the upper surface of a ceramic substrate 2, which is shaped like a rectangular parallelepiped. A pair of upper electrodes 4 is positioned in a region covering both longitudinal ends of the resistive element 3. The resistive element 3 exposed between the pair of upper electrodes 4 is covered with an insulating protective layer 5 that is made, for instance, of glass. Further, end-face electrodes 6 are positioned on both longitudinal end faces of the ceramic substrate 2. The upper ends of the end-face electrodes 6 overlap with the upper electrodes 4 and are closely joined. In addition, each end-face electrode 6 is covered, for instance, with two plating layers (nickel-plating layer 7 and solder-plating layer 8) to avoid electrode loss and provide enhanced solder reliability. In some cases, a tin-plating layer may be formed in place of the solder-plating layer.

When the chip resistor 1 configured as described above is to be mounted on a circuit board 30, the pair of end-face electrodes 6, which are extended over both longitudinal ends of the lower surface of the ceramic substrate 2, are placed on the associated solder land 31*a* of a wiring pattern 31 of the circuit board 30 and subjected to a solder connection process so that the plating layers 7, 8 covering the end-face electrodes 6 are connected with solder 32 to the solder land 31*a* to establish an electrical and mechanical connection. The copper-nickel alloy has a small temperature coefficient of resistance (TCR). Therefore, when the resistive element 3 is made mainly of a copper-nickel alloy, it is possible to obtain a low-resistance, low-TCR chip resistor having a resistance value setting of not higher than 1Ω. Patent Document 1: Japanese Patent Application Laid-Open Publication No. H10-144501 (pages 4 and 5, FIG. 1)

DISCLOSURE OF THE INVENTION

Problem to be Solved by the Invention

As described above, a low-resistance, low-TCR chip resistor can be obtained when the resistive element is made mainly of a copper-nickel alloy. However, when the conventional chip resistor 1 shown in FIG. 5 is used, it is difficult to further decrease its resistance because the inductance of the end-face electrodes 6 cannot be ignored. When the chip resistor 1 is mounted on the wiring pattern 31 of the circuit board 30, power is distributed to the upper electrodes 4 and resistive element 3 through the end-face electrodes 6. However, the end-face electrodes are extended from the lower end of the ceramic substrate 2 to the upper end. Therefore, a resistance value that would inhibit the chip resistor 1 from lowering its resistance is unavoidably generated by the end-face electrodes 6.

This type of chip resistor is manufactured by subjecting a large-size, multi-chip substrate to primary division to obtain strip-shaped substrates and then subjecting the strip-shaped substrates to secondary division to obtain individual pieces. In the case of the aforementioned chip resistor 1, however, the resistive element 3, which is made mainly of a copper/nickel alloy, is formed across a primary division break groove in the large-size substrate. Therefore, the work performed to divide the large-size substrate into strips along the break groove is troubled. Consequently, the manufacturing yield is adversely affected.

The present invention has been made in view of the conventional technology described above. An object of the present invention is to provide a chip resistor that readily lowers its resistance and exhibits excellent manufacturing yield.

Means of Solving the Problem

In accomplishing the above object, according to one aspect of the present invention, there is provided a chip resistor including: a ceramic substrate shaped like a rectangular parallelepiped; a resistive element that is placed on the lower surface of the ceramic substrate, positioned within a region inside the peripheral border of the lower surface, and made mainly of copper; a pair of first electrode layers that are positioned in regions covering both longitudinal ends of the resistive element; a pair of second electrode layers that are positioned in regions covering the first electrode layers; an insulating protective layer that is positioned to cover the resistive element exposed between the second electrode layers; a pair of end-face electrodes that are positioned on both longitudinal end faces of the ceramic substrate with the lower end closely attached to the second electrode layers; and a plating layer that covers the second electrode layers and the end-face electrodes; wherein the plating layer is soldered to a wiring pattern on a circuit board with the first and second electrode layers positioned on the wiring pattern to mount the chip resistor on the circuit board.

The chip resistor configured as described above has a resistive element made of a low-resistance, low-TCR material. Further, when it is face-down mounted, that is, mounted with the resistive element side facing the component side of the circuit board, it can distribute power to the resistive element while bypassing the end-face electrodes. Furthermore, the electrode section of the resistive element includes two layers, that is, the first and second electrode layers, to provide increased film thickness. Therefore, an extremely small inductance setting can be employed for the electrode section. Consequently, the chip resistor can readily lower its resistance and improve TCR characteristics. In addition, the resistive element is placed on the lower surface of the ceramic substrate and positioned within a region inside the peripheral border of the lower surface. Therefore, the resistive element does not enter the primary division break groove in the large-size substrate during the manufacture of the chip resistor. This makes it possible to smoothly perform primary division work and achieve excellent manufacturing yield. Although the end-face electrodes of the chip resistor do not constitute an electrical contribution, they create a solder fillet when they are mounted on and soldered to the wiring pattern of the circuit board. Therefore, the end-face electrodes considerably increase the mounting strength prevailing after mounting.

According to another aspect of the present invention, there is provided the chip resistor as described in the above aspect, wherein the first and second electrode layers are of the same shape and overlap with each other. In this instance, the initial cost decreases because the electrode layers can be formed through the use of the same equipment.

EFFECTS OF THE INVENTION

The chip resistor according to the present invention includes a resistive element that is made of a low-resistance, low-TCR material. Further, when it is face-down mounted, it can distribute power to the resistive element while bypassing the end-face electrodes. Furthermore, the electrode section of the resistive element includes two layers, that is, the first and second electrode layers, and permits the use of an extremely small inductance setting. Consequently, the chip resistor can readily lower its resistance and improve TCR characteristics. In addition, the resistive element does not enter the primary division break groove in the large-size substrate when the chip resistor is manufactured. Therefore, even when the resistive element is made of a highly-ductile material containing copper, the chip resistor generates no burrs. Consequently, the primary division work can be smoothly performed to achieve excellent manufacturing yield. Moreover, when the chip resistor is mounted on a circuit board, the end-face electrodes create a solder fillet. This makes it easy to obtain required mounting strength.

BEST MODE FOR CARRYING OUT THE INVENTION

Embodiments of the present invention will now be described with reference to the accompanying drawings. FIG. 1 is a cross-sectional schematic view illustrating a chip resistor according to an embodiment of the present invention. FIG. 2 is a cross-sectional view illustrating a manufacturing process for the chip resistor. FIG. 3 is a plan view illustrating a manufacturing process for the chip resistor. FIG. 4 is a cross-sectional view illustrating an essential part of the chip resistor mounted on a circuit board.

The chip resistor 10 shown in the above figures is of a low-resistance, low-TCR type and is to be face-down mounted on a circuit board 30. This chip resistor 10 includes a ceramic substrate 11 that is shaped like a rectangular parallelepiped. Mounted on the lower surface of the ceramic substrate 11 are a resistive element 12 that is made mainly of a copper-nickel alloy, first and second electrode layers 13, 14 that form a two-layer structure and cover both longitudinal ends of the resistive element 12, and an insulating protective layer 15 for covering the resistive element 12 within a region that is not covered by the electrode layers 13, 14. The chip resistor 10 also includes upper electrodes 16 that are placed on both longitudinal ends of the upper surface of the ceramic substrate 11. End-face electrodes 17 bridge both electrode layers 13, 14 and upper electrodes 16 that are in the corresponding positions. Further, the second electrode layers 14 and both electrodes 16, 17 are covered by four plating layers 18-21.

The ceramic substrate 11 is an alumina substrate, which is one of a large number of substrates obtained by dividing a large-size substrate (not shown) vertically and horizontally. The resistive element 12 is provided in all regions except the peripheral border of the lower surface of the ceramic substrate 11. Both longitudinal ends of the resistive element 12 are covered by a pair of first electrode layers 13. The first electrode layers 13 are covered respectively by the second electrode layers 14. The first electrode layers 13 and second electrode layers 14 are of the same shape and overlap with each other. The first and second electrode layers 13, 14 form an electrode section for the resistive element 12. The first and second electrode layers 13, 14 are both made of a copper-based (or silver-based) highly conductive material and equal in film thickness. The protective layer 15 is made of insulating resin such as epoxy-based resin. Both ends of the protective layer 15 overlap with each second electrode layer 14. Although a pair of upper electrodes 16 and a pair of end-face electrodes 17 do not actually function as electrodes, they serve as a foundation layer for the plating layers 18-21, thereby contributing toward solder connection strength enhancement. The upper electrodes 16 are made of a copper-based (or silver-based) highly conductive material, whereas the end-face electrodes 17 are made of a nickel-chrome-based highly conductive material. As shown in FIG. 4, the lower ends of the end-face electrodes 17 are closely attached to the first and second electrode layers 13, 14, and the upper ends of the end-face electrodes 17 are closely attached to the upper electrodes 16. The innermost layer of the four plating layers 18-21 is a nickel-plating layer 18. The second innermost layer is a copper-plating layer 19. The third innermost layer is a nickel-plating layer 20. The outermost layer is a tin-plating layer 21. A marking layer 22, which is made of insulating resin, is printed on the center of the upper surface of the ceramic substrate 11.

The manufacturing process for the chip resistor 10, which is configured as described above, will now be described mainly with reference to FIGS. 2 and 3. These figures show only one chip area. In reality, however, a large number of chip resistors are simultaneously manufactured. Therefore, a large-size, multi-chip substrate (not shown) is provided with a large number of chip areas. Substrate strips (not shown), which are obtained by dividing the large-size substrate into strips, are provided with a plurality of chip areas.

First of all, copper-based (or silver-based) conductive paste is printed onto one surface of a large-size, multi-chip substrate (the upper surface of the ceramic substrate 11) and baked to form the upper electrodes 16 on both longitudinal ends of each chip area (the area enclosed by a two-dot chain line in FIGS. 3A to 3F) as shown in FIG. 2(*a*). Next, conductive paste made mainly of a copper-nickel alloy is printed onto the other surface of the large-size substrate (the lower surface of the ceramic substrate 11) and baked to form the resistive element 12 in all regions except the peripheral border of each chip area as shown in FIGS. 2(*b*) and 3(*a*).

Subsequently, copper-based (or silver-based) conductive paste is printed onto a region covering both longitudinal ends of each resistive element 12 and baked to form the first electrode layers 13 as shown in FIGS. 2(*c*) and 3(*b*). Next, copper-based (or silver-based) conductive paste is printed onto a region covering each first electrode layer 13 and baked to form the second electrode layers 14 as shown in FIGS. 2(*d*) and 3(*c*). Since the first electrode layers 13 and second electrode layers 14 may be equal in material, shape, and formation position, they can be sequentially formed without changing the manufacturing equipment. Further, the first and second electrode layers 13, 14 are printed in such a manner that they do not overlap with the peripheral border of each chip area. Therefore, it is unlikely that the first and second electrode layers 13, 14 will enter a division break groove in the large-size substrate.

Next, as shown in FIGS. 2(*e*) and 3(*e*), a trimming groove 12*a* is formed in the resistive element 12 exposed between the second electrode layers 14 with a laser or the like to adjust the resistance value with a resistance measurement probe (not shown) brought into contact with the pair of second electrode layers 14 in each chip area. Subsequently, as shown in FIGS. 2(*f*) and 3(*e*), epoxy-based or other resin paste is printed to cover the resistive element 12 exposed between the pair of second electrode layers 14 and heat-hardened to form the insulating protective layer 15 that crosses each chip area. Further, the same resin paste as for the protective layer 15 is printed onto the opposite surface of the large-size substrate and heat-hardened to form the marking layer 22 in each chip area.

Next, the large-size substrate is divided into strips along a primary division break groove. Nickel chrome is then sputtered onto the exposed division surfaces of each substrate strip to form the end-face electrodes 17 whose both ends are closely attached to the first and second electrode layers 13, 14 and upper electrodes 16 as shown in FIGS. 2(*g*) and 3(*f*).

Subsequently, the substrate strips are divided into individual pieces along a secondary division break groove. The individual pieces are then sequentially subjected to electrolytic plating to form the four plating layers 18-21 as shown in FIGS. 1 and 3(*g*). The chip resistor 10 is now completed. The electrolytic plating process is performed by covering the second electrode layers 14, upper electrodes 16, and end-face electrodes 17 with a nickel-plating layer 18, covering the nickel-plating layer 18 with a copper-plating layer 19, covering the copper-plating layer 19 with a nickel-plating layer 20, and finally covering the nickel-plating layer 20 with a tin-plating layer 21. These plating layers 18-21 prevent electrode breakage and provide enhanced reliability. At least two plating layers are required. It is not always necessary to provide four plating layers.

The chip resistor 10 manufactured as described above is face-down mounted with the first and second electrode layers 13, 14 placed on the wiring pattern 31 of the circuit board 30. Therefore, the protective layer 15, which covers the resistive element 12, faces the component side of the circuit board 30, and the tin-plating layer 21, which is the outermost layer of the chip resistor 10, is connected with solder 32 to a solder land 31*a* of the wiring pattern 31 to establish an electrical and mechanical connection. In this instance, the end-face electrodes 17, which are erect above the solder land 31*a*, form a solder fillet 32*a*. This sufficiently increases the mounting strength of the chip resistor 10 relative to the circuit board 30, thereby providing adequate reliability.

As described above, the chip resistor 10 according to the present embodiment includes a low-resistance, low-TCR resistive element 12. Further, when face-down mounted, this chip resistor 10 can distribute power to the resistive element 12 while bypassing the end-face electrodes 17. Furthermore, the electrode section for the resistive element 12 has a two-layer structure, which includes the first and second electrode layers 13, 14, to provide increased film thickness. Therefore, an extremely small inductance setting can be employed for the electrode section. Consequently, the chip resistor 10 can readily lower its resistance and improve TCR characteristics.

In addition, the resistive element 12 for the chip resistor 10 is placed on the lower surface of the ceramic substrate 11 and positioned within a region inside the peripheral border of the lower surface. Therefore, the resistive element 12 does not enter the primary division break groove in the large-size substrate during the manufacture of the chip resistor. Moreover, the first and second electrode layers 13, 14 are printed in such a manner that they do not enter the division break groove in the large-size substrate. Therefore, the chip resistor 10 makes it possible to smoothly perform primary division work and secondary division work and achieve excellent manufacturing yield.

EXPLANATION OF REFERENCE NUMERALS

Figure 1:
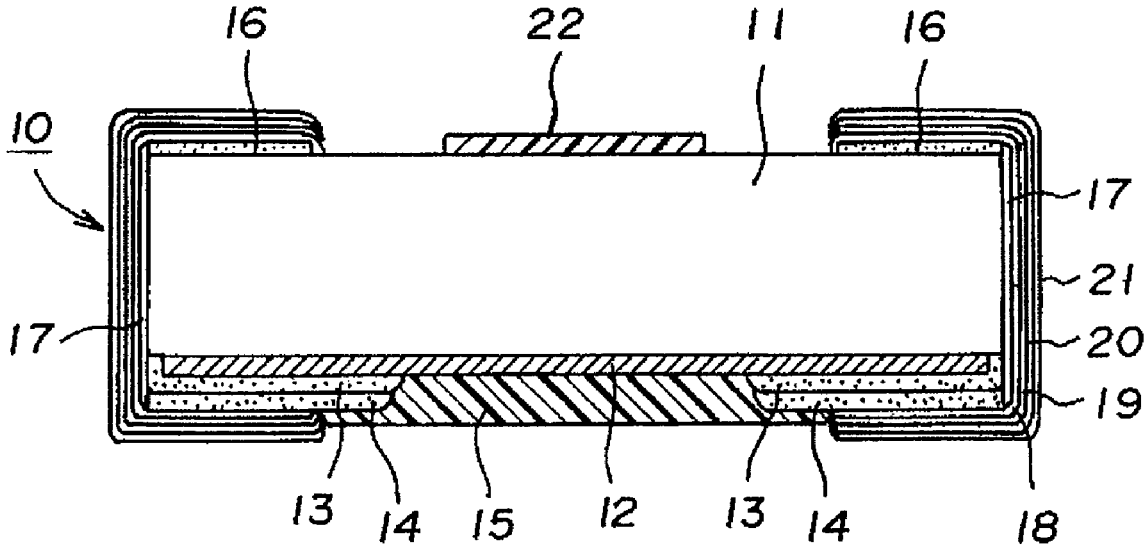
FIG. 1 is a cross-sectional schematic view illustrating a chip resistor according to an embodiment of the present invention.
Figure 2:
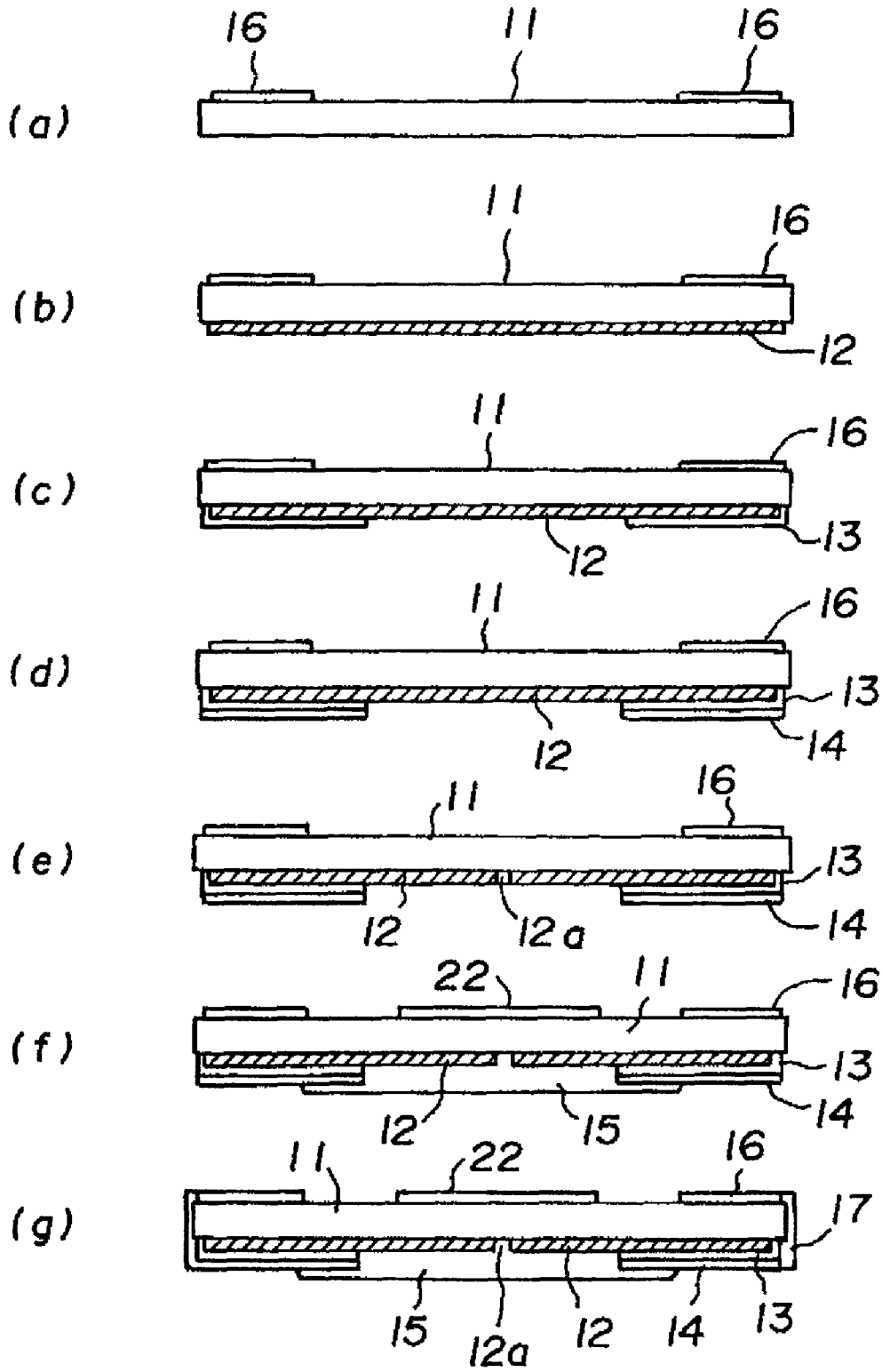
FIG. 2 is a cross-sectional view illustrating a manufacturing process for the chip resistor.
Figure 3:
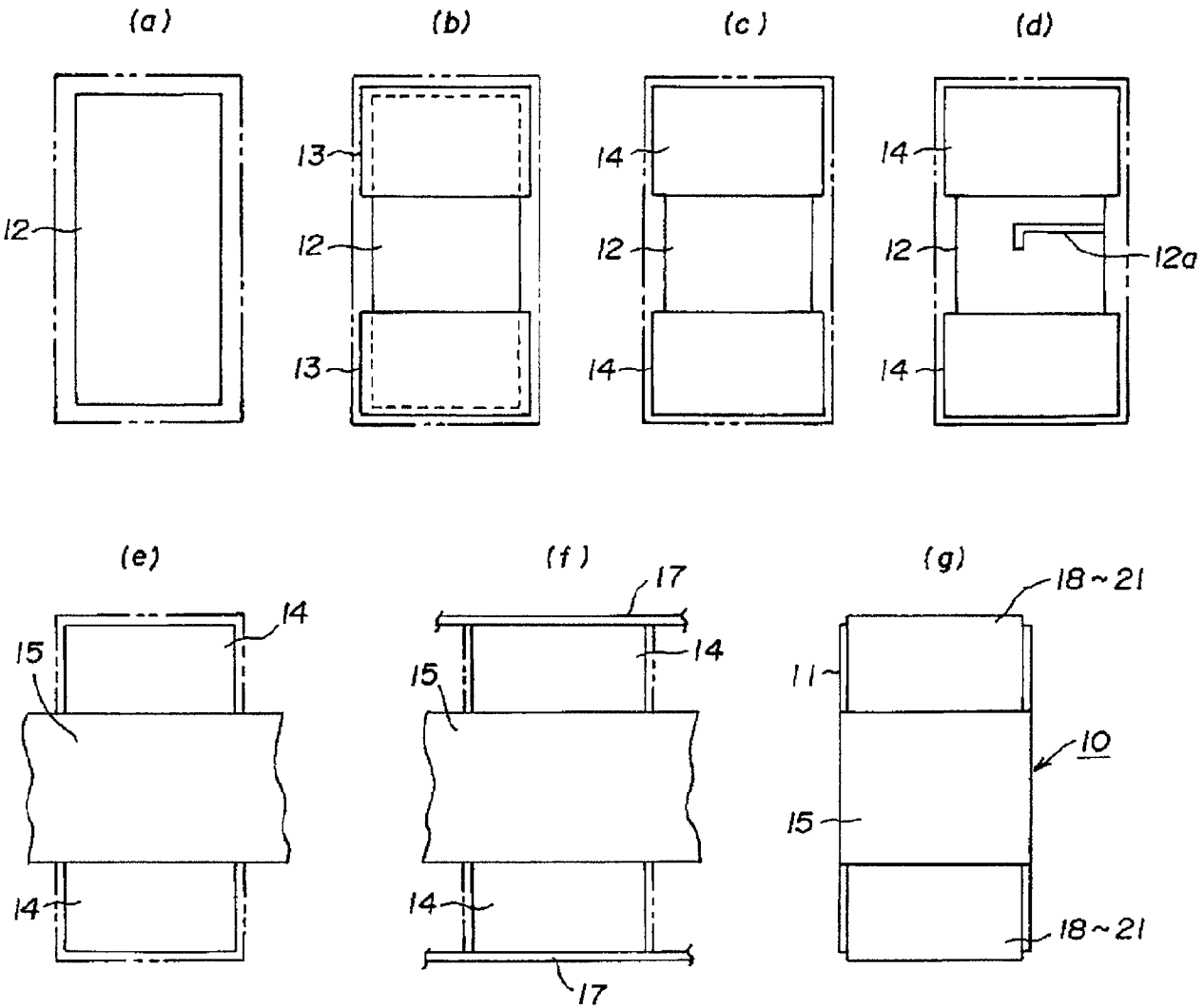
FIG. 3 is a plan view illustrating a manufacturing process for the chip resistor.
Figure 4:
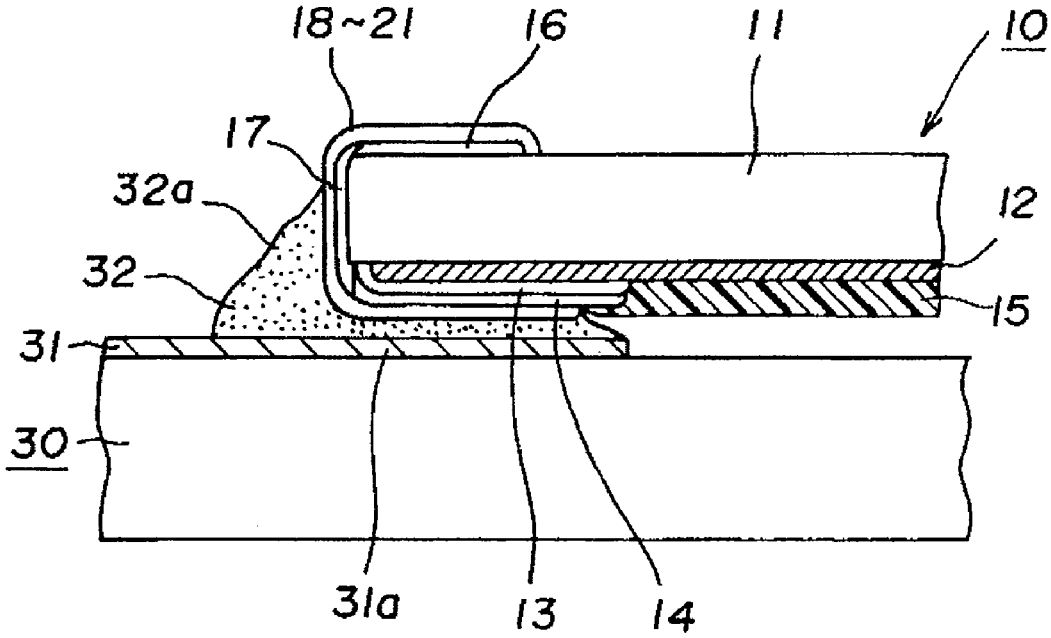
FIG. 4 is a cross-sectional view illustrating an essential part of the chip resistor mounted on a circuit board.
Figure 5:
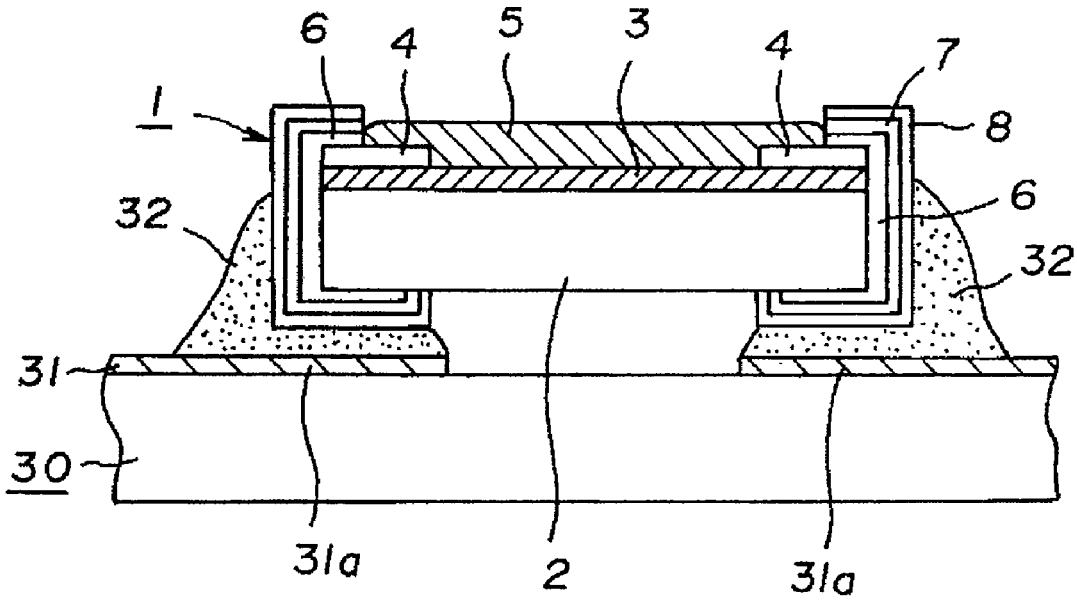
FIG. 5 is a cross-sectional schematic view illustrating a related low-resistance chip resistor.

10: Chip resistor
11: Ceramic substrate
12: Resistive element
12*a*: Trimming groove
13: First electrode layer
14: Second electrode layer
15: Protective layer
16: Upper electrode
17: End-face electrode
18-21: Plating layer
30: Circuit board
31: Wiring pattern
31*a*: Solder land
32: Solder
32*a*: Solder fillet

The invention claimed is:

1. A chip resistor comprising:

a ceramic substrate shaped like a rectangular parallelepiped;

a resistive element that is placed on the lower surface of the ceramic substrate, positioned within a region inside the peripheral border of the lower surface, and made mainly of copper;

a pair of first electrode layers that are positioned in regions covering both longitudinal ends of the resistive element;

a pair of second electrode layers that are positioned in regions covering the first electrode layers;

an insulating protective layer that is positioned to cover the resistive element exposed between the second electrode layers;

a pair of end-face electrodes that are positioned on both longitudinal end faces of the ceramic substrate with the lower end closely attached to the second electrode layers; and a plating layer that covers the second electrode layers and the end-face electrodes;

wherein the plating layer is soldered to a wiring pattern on a circuit board with the first and second electrode layers positioned on the wiring pattern to mount the chip resistor on the circuit board.

2. The chip resistor according to claim 1, wherein the first electrode layers and the second electrode layers are of the same shape and overlap with each other.

* * * * *